US005277935A

United States Patent [19]

Coughlin

[11] Patent Number: 5,277,935

[45] Date of Patent: Jan. 11, 1994

[54] METHOD OF COATING WITH MULTIPLE LAYERS OF LATEX TO PRODUCE FIRE RESISTANT HOSE DUCTING FABRIC

[75] Inventor: Thomas E. Coughlin, Tyngsboro, Mass.

[73] Assignee: Worthen Industries, Inc., Nashua, N.H.

[21] Appl. No.: 827,374

[22] Filed: Jan. 29, 1992

[51] Int. Cl.[5] ..... B05D 3/02

[52] U.S. Cl. ..... 427/393.3; 427/412; 427/379; 427/365

[58] Field of Search ..... 427/393.3, 412, 365, 427/379

[56] References Cited

U.S. PATENT DOCUMENTS

| | | | |
|---|---|---|---|
| 2,771,379 | 11/1956 | di Dario | 427/393.3 |
| 2,852,414 | 9/1958 | Broatch | 427/393.3 |
| 2,977,243 | 3/1961 | Meier | 427/365 |
| 3,398,016 | 8/1968 | Goldman et al. | 427/365 |
| 3,637,409 | 1/1972 | Hartman | 427/393.5 |
| 4,284,682 | 8/1981 | Tschirch et al. | 427/393.3 |
| 4,425,372 | 1/1984 | Baldwin | 427/393.3 |
| 4,668,540 | 5/1987 | Long et al. | 427/412 |
| 4,746,565 | 5/1988 | Bafford et al. | 427/407.3 |
| 4,753,823 | 6/1988 | Long | 427/428 |

*Primary Examiner*—Shrive Beck
*Assistant Examiner*—Diana Dudash
*Attorney, Agent, or Firm*—Samuels, Gauthier & Stevens

[57] ABSTRACT

Method of coating woven fabric with a first latex compound having a viscosity of 18,000 to 20,000 cps, and containing a fire resistant additive. Then coating with a second latex compound to produce a hose ducting fabric which is fire resistant. The second latex compound preferably contains a fire resistant additive also, and may be of a viscosity between 20,000–30,000 cps.

10 Claims, 2 Drawing Sheets

METHOD OF COATING WITH MULTIPLE LAYERS OF LATEX TO PRODUCE FIRE RESISTANT HOSE DUCTING FABRIC

FIELD OF THE INVENTION

The invention is directed to a fabric used with a flexible duct.

BACKGROUND AND BRIEF SUMMARY OF THE INVENTION

In flexible ducts, a fabric or film is secured to a helical wire. The fabric can be secured by adhesives, crimping or sewing. The ducts are typically used to exhaust gases and vapors from a confined working area, i.e. the holds of ships, below ground electrical conduits, etc. The ducts must be flexible, extendable, collapsible, gas impermeable, fire resistant and abrasion resistant. The fabric which is secured to the steel wire primarily affects all these characteristics.

The fabric customarily used for duct material is a woven or non-woven material which is saturated and/or coated. The fabrics that are particularly used for this purpose are square woven, oxford or duck. These fabrics, when coated, result in a duct with poor flexibility, poor elongation rates and limited compressibility. Attempts to modify the coatings to improve these characteristics result in decreased resistance to wear (abrasion) and lower fire resistance.

The present invention overcomes these problems by using a fabric of a particular weave in combination with saturation and coating techniques and the components used, to provide a duct fabric of superior flexibility, collapsibility, elongation, fire resistance and abrasion resistance.

Broadly the invention comprises a duct fabric which comprises a woven twill fabric saturated with a latex-based, fire resistant compound at a first lower viscosity and coated with a second higher viscosity, latex-based, fire resistance compound compatible with the first lower viscosity compound. The fabric of the invention allows controlled elongation up to 55% in the warp direction and up to 22% in the filling direction. It also provides increased flexibility, compression, high abrasion resistance, and fire resistance.

DESCRIPTION OF THE PREFERRED EMBODIMENT(S)

Figure 1:
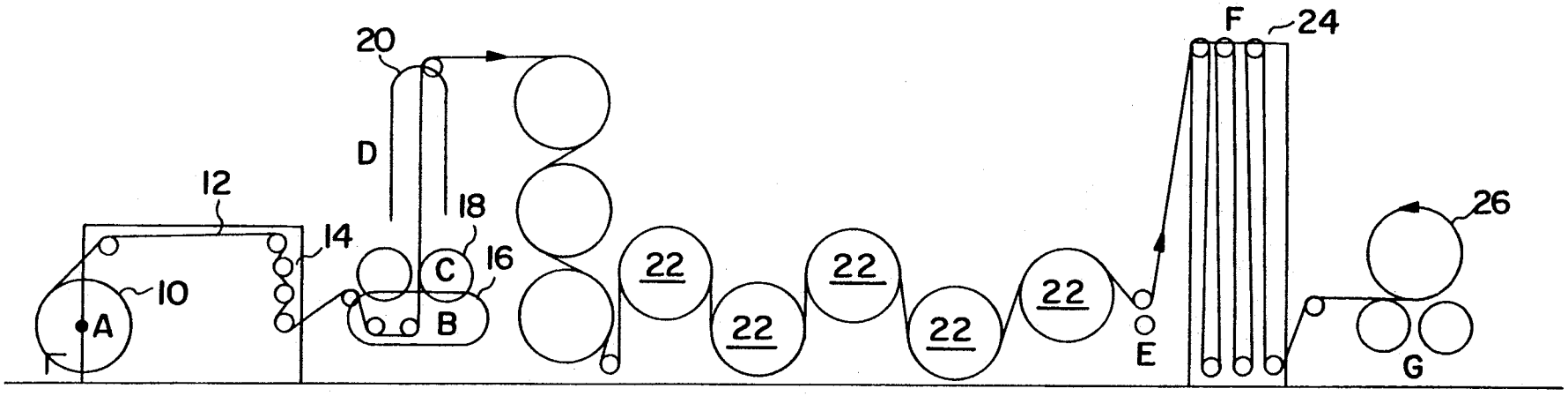
FIG. 1 is a process flow diagram of saturation step used in the invention.
Figure 2:
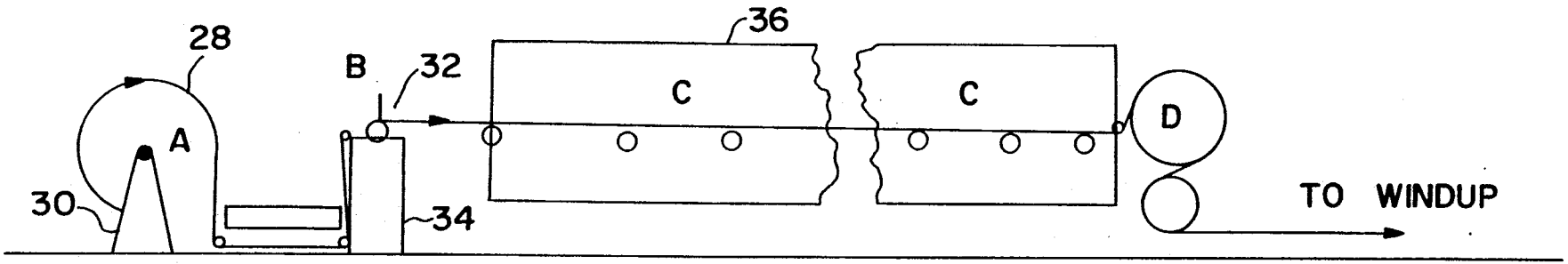
FIG. 2 is a process flow diagram of a coating step used in the invention.

Referring to FIG. 1, a woven twill fabric and specifically a blend polyester cotton fabric with the yarns woven in a right hand twill, such as a 1.24 twill (S/26156/58 inch 66×33 0.027 inch ga. Walton-Monroe Mills approximately 8.05 oz/sq. yard) is carried on a let-off unwind roll 10. In a dip tank 16 is a neoprene latex available from Upaco Adhesives, Inc., Product No. 5955. This is a water-based latex system fortified with antimony trioxide synergized with a halogenator (pvc) to impart fire resistance.

Antioxidants, thickeners, acid acceptors, curing agents and other conventional rubber compounding agents can be added as desired. Whether or not they are added will depend upon the specific operating process parameters and the election to add or not to add the various agents is well within the skill of the art.

The viscosity of the latex is adjusted to between 18,000–20,000 cps (Brookfield 20 rpm #5 spindle) by adding cellulosic thickening agents. The fabric 12 is led under controlled tension and threaded over idle rolls 14 until it reaches the dip tank 16. The fabric is completely immersed in the dip tank 16 and the wet-out fabric subsequently moves upwardly from the tank 16 and passes through a pair of chrome-plated heavy nip rolls 18 where pressure is applied, say at between about 10 to 20 psig at the nip to remove all surplus latex compound and to ensure an even saturated coating of approximately 2.75 oz/sq. yd. pickup. After passing through the nip rolls 18, the saturated fabric passes through an infrared pre-dryer 20 at a temperature of 280° F., through steel smoothing rolls 22 onto an accumulator 24 and collected on a takeup roll 26.

The takeup roll 26 is positioned on an A-frame 30 upstream of a knife-over-roll blade coater head 32. A tank 34 contains the same compound as used in tank 16 but the compound is thickened to 20,000–30,000 cps by cellulosic thickeners. This coating is applied evenly in a predetermined weight. Surface coatings are applied upon both sides of the fabric as shown in a separate operation. Obviously the fabric may be coated on both sides simultaneously and/or sequentially as desired. The fabric then passes through conventional zone hot air gas fired oven 36 at a temperature of 280° F.

The weight ratio of the final saturated and coated fabric, weight of cloth 47% based on total weight, saturation coat 33%, and surface coating 20%. The preferable ranges of the weight ratios are 49%–50% for the weight of the cloth, 30%–35% for the weight of the saturation coating and the weight of the surface coating is preferably in the range of 19%–21%.

The proper ratio of coating compound to fabric weight is most important. Improper balance will cause lack of fire resistant qualities and/or poor abrasion resistance of the coated fabric.

Figure 3:
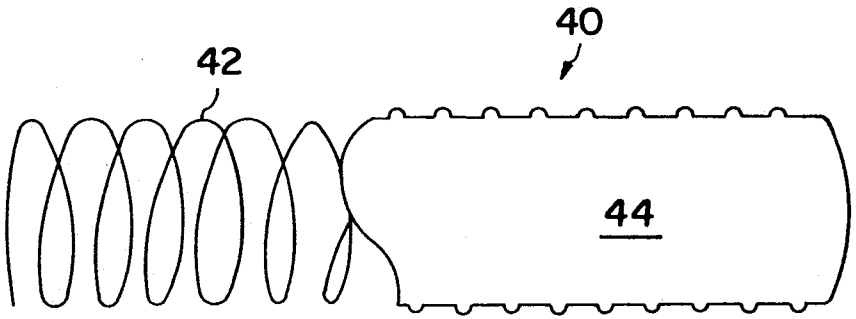
FIG. 3 is a perspective, partly fragmentary view of a duct with the fabric of the invention.

FIG. 3 shows a duct 40 which comprises a wire helix 42 having the fabric 44 of the invention secured thereto.

A fabric prepared according to the just described process was tested for flexibility, elongation, compressibility, fire resistance and abrasion resistance with the following results.

Compression—A 20 foot length of flexible hose ducting of 6 inch diameter was tested for its ability to compress at 20 psig by collapsing a wire helix supported fabric in the long dimension to 55% of its original length.

A force of 20 psig is the maximum allowed to induce compression. When the pressure was released, the ducting extended to its original length.

Elongation—A 4"×6" sample of the coated fabric was subjected to elongation on a Scott Tensile Tester. The elongation was noted as the extension between bench marks at the moment of rupture. The elongation is expressed as a percentage of the original distance between the bench marks and for the fabric the percentage was 55%.

Fire Resistance—A 2¾"×10" strip sample of the coated fabric was held in a vertical position in a metal frame while a 1½" gas flame was applied at the lower end for 12 seconds. The flame time recorded is the length of time, in seconds, for which the flame continues to burn after the removal of the gas burner flame. The char length is also noted. The allowable flame time is not more than 4 seconds to extinguishment; and char length is not more than 6 inches. UL 94 VO and Federal Test Method 191A Test 5903. The fabric passed the test.

Abrasion—Samples 6×6 inches of the coated fabric were abraded on one surface (face) with a Taber Abrader, H-18 grit wheels, 1000 gram load. The end point is reported in the cycles needed to penetrate the neoprene rubber coated fabric. A minimum cycle requirement is not less than 1500 cycles. The fabric passed the minimum requirement.

Flexibility—A ½"×1" strip of coated fabric was placed on a Gurley pendulum tester and clamped in vertical position. The force needed to move the pendulum to a recorded level on the dial is averaged in both right and left directions. The stiffer the sample, the higher the dial reading. The fabric shall not exceed 1.0 units. The fabric did not exceed 1.0 units.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method of manufacturing a duct fabric comprising:

providing a woven twill fabric;

saturating the fabric with a first latex based compound having a viscosity of between 18,000–20,000 cps to form a saturated fabric, said latex compound having an effective amount of a fire resistant additive;

coating the saturated fabric with a second latex based compound to form a coated fabric; and drying the coated fabric to produce a duct fabric which is fire resistant and which has an elongation value of up to 55% in the warp direction.

2. The method of claim 1 wherein the first latex based compound is a neoprene latex.

3. The method of claim 1 which further comprises:

passing the saturated fabric through a pair of nip rolls at a pressure of about 10 to 20 psig to remove surplus latex before said coating step.

4. The method of claim 3 which further comprises:

drying the saturated fabric at a temperature of about 280° F. prior to said coating step to form a dried saturated fabric.

5. The method of claim 5 which further includes: passing the dried saturated fabric through smoothing rolls prior to said coating step.

6. The method of claim 5 which further comprises:

performing the coating step on both sides of the dried saturated fabric with the second latex compound, the second latex compound having a viscosity of between 20,000–30,000 cps.

7. The method of claim 6 which further comprises:

drying by passing the coated fabric through a zone gas fired oven at a temperature of 280° F.

8. The method of claim 7 wherein the weight of the fabric is about 47.1% of the total weight, the saturation coat is about 17.6% and the surface coating is about 35.3%.

9. The method of claim 6 wherein the second latex based compound has an effective amount of a fire resistant additive.

10. The method of claim 9 wherein the duct fabric has a compression value of up to 55%.

* * * * *